United States Patent [19]

Wittmann et al.

[11] Patent Number: 5,006,755

[45] Date of Patent: Apr. 9, 1991

[54] MERCURY DISCHARGE LAMP WITH MERCURY CONTAINING CAPSULE

[75] Inventors: Horst Wittmann, Stadtbergen; Michael Dietrich, Friedberg; Erolf Weinhardt, Diedorf, all of Fed. Rep. of Germany

[73] Assignee: Patent Treuhand Gesellschaft fur elektrische Gluhlampen m.b.H., Munich, Fed. Rep. of Germany

[21] Appl. No.: 475,459

[22] Filed: Feb. 6, 1990

[30] Foreign Application Priority Data

Mar. 7, 1989 [DE] Fed. Rep. of Germany ..... 3907277

[51] Int. Cl.[5] ..... H01J 61/28; H01J 17/22

[52] U.S. Cl. ..... 313/546; 313/490

[58] Field of Search ..... 313/546, 490

[56] References Cited

U.S. PATENT DOCUMENTS

| | | | |
|---|---|---|---|
| 2,288,253 | 6/1942 | Reuter | 313/546 |
| 3,764,842 | 10/1973 | Ridders et al. | 313/546 |
| 3,794,402 | 2/1974 | Ridders et al. | 313/546 X |
| 3,794,403 | 2/1974 | Ridders et al. | 313/546 X |
| 4,056,750 | 11/1977 | Latassa | 313/546 |
| 4,182,971 | 1/1980 | Cassidy et al. | 313/546 |
| 4,335,326 | 6/1982 | Latassa et al. | 313/546 |
| 4,495,440 | 1/1985 | Schlitt et al. | 313/546 X |
| 4,808,136 | 2/1989 | Schuster | 445/9 |

FOREIGN PATENT DOCUMENTS

| | | | |
|---|---|---|---|
| 2161024 | 7/1972 | Fed. Rep. of Germany . | |
| 2030306 | 7/1976 | Fed. Rep. of Germany . | |
| 2747043 | 6/1978 | Fed. Rep. of Germany . | |
| 2927350 | 1/1980 | Fed. Rep. of Germany . | |
| 135466 | 10/1979 | Japan | 313/546 |

*Primary Examiner*—Palmer C. DeMeo

*Attorney, Agent, or Firm*—Frishauf, Holtz, Goodman & Woodward

[57] ABSTRACT

To improve mass production of fluorescent lamps, and introduction of mercury within the interior thereof, the lamp mount includes an electrically conductive strip, band or wire secured within the vessel, to which a heater wire (11, 31, 40) is connected, the heater wire being melt-connected to extend into the glass capsule, forming therein a narrow V, or U-shaped structure. Upon application of a high frequency field, the heater wire will heat and open the glass capsule in the region of the melt-through connection thereof, thus liberating mercury previously introduced into the glass capsule, for example in the form of a drop, a pellet of porous substance with mercury dispersed therein, or the like.

20 Claims, 4 Drawing Sheets

MERCURY DISCHARGE LAMP WITH MERCURY CONTAINING CAPSULE

Reference to related patents, the disclosures of which are hereby incorporated by reference:

U.S. Pat. Nos. 4,808,136, 4,182,971, 4,056,750, 3,794,403, 3,794,402, 3,764,842.

FIELD OF THE INVENTION

The present invention relates to a discharge lamp which includes mercury which, in operation of the lamp, vaporizes, and more particularly to a low-pressure mercury vapor discharge lamp, such as a fluorescent lamp, and essentially to the structure of an electrode mount for such a lamp.

BACKGROUND

The referenced U.S. Pat. No. 4,056,750 is a good historical survey over various ways to provide mercury in fluorescent lamps. The methods described in this reference are not suitable for high-speed mass production, and particularly high-speed automatic mass production. The patent describes a lamp which suitably has a shield band surrounding the filament, the shield band being formed with a gap. A metallic encapsulation element for mercury is so welded into the gap that the shield band is electrically closed. Upon application of a high-frequency current, by induction, the encapsulating element for the mercury is so heated that it will break and release the mercury.

It has been found that this arrangement is not entirely reliable to be suitable for mass production. Upon heating of the metallic capsule, contamination of the atmosphere within the lamp may result due to evaporation of material which adhered to the metallic encapsulating element.

The referenced U.S. Pat. No. 4,182,971 describes an elongated glass capsule for the mercury. A heating wire is placed axially through the glass capsule, extending therefrom at both sides. The glass capsule, again, is opened, or broken, by a high-frequency induction system.

This arrangement is difficult to make since introduction of mercury into the glass capsule is not easy. The heating wire must be melted into both ends of the glass capsule, which causes difficulties upon sealing the second end due to heat transfer through the wire to the end already sealed into the capsule. The heating may cause the mercury to develop a vapor pressure which interferes with the tight seal. Mercury may escape which, then, is missing in the lamp fill and its pressure.

The referenced U.S. Pat. Nos. 3,764,842, 3,794,402 and 3,794,403 describe a method and a lamp made in accordance with the method in which a closed glass capsule, retaining mercury, is pinched between an electrical conductor, namely the shield band, and the heating wire. In this arrangement the glass capsule must be additionally secured or retained in order to prevent uncontrolled rolling of the open glass capsule, or parts thereof, within the lamp bulb or tube. Any fragments which may be within the lamp bulb or tube may damage the filament and/or the fluorescent coating.

THE INVENTION

It is an object to provide an arrangement in which only the minimum requirement of mercury is introduced within the lamp, with constant dosing, and which lends itself to mass production, especially mass production of fluorescent lamps.

Briefly, a capsule is used which defines two end portions. A heater wire is provided, bent upon itself, to form a narrow V or U structure; it may, actually, be formed by two wires, connected at the apex of the V. The wire defines two leg portions which extend in the same direction and, at least in part, are somewhat or generally parallel to each other. The wires are melted into a first end of the elongated capsule, and the apex of the V is connected interiorly of the capsule. The other, or free wire ends are then connected to the wrap-around shield, separated by a gap. Upon applying of inductance heating, the capsule will be opened.

The structure of the present invention has the advantage that the reliability as well as the opening mechanism and the holding structure of the glass capsule are improved. This is of substantial importance in mass production, and especially mass production of fluorescent lamps. Reliable opening of the capsule is obtained by embedding the heating wire twice in the same melt seal of the capsule, which may also be a pinch or press seal. Thus, and in contrast to the prior art structure, the unexpected and surprising result is obtained that reliability of tearing of the capsule rises not linearly, but superproportionally. Heating of the wires will form a fissure along the embedding of the heating wire in the seal or pinch seal; additionally, the heat which is generated in one of the seals, that is, in the seal of one of the wires, due to the slight spacing from the other sealed wire, results in rapid formation of a melt fissure also of the other wire. This effect is utilized to decrease the time required to tear the capsule.

Reliability of rapid opening of the capsule can be additionally improved by making the shield of resilient material and welding the heating wire to the shield under compressive stress. Upon heating of the seal, and especially of a pinch seal, the wire has a tendency to stretch and expand, together with the shield tape or band, which additionally supports the formation of the tearing fissure for the capsule.

As an alternative, or as an additional feature, it is possible to make the heating wire itself of a resilient material, and so melt-connect it into the glass capsule that it is under compressive stress; another possibility is to melt-connect the heating wire into the glass capsule without any stress and then connect it under tension to the shield band.

To obtain as good a heating effect as possible, a heating wire with high resistance should be used. The heating wire may, thus, be formed of a plurality of sections with different diameter, varying, for example, between 0.2 to 1.5 mm, and connected together by butt welding.

Electrical resistance can be optimized by suitable selection of the material, and especially of material with very high specific resistance. An alloy of 50% iron, 47% nickel and 3% chrome has been found particularly suitable; this alloy is known under the tradename "VACOVIT", which has a specific resistance $\rho=0.92$ $\Omega$ mm$^2$/m at 20° C. The coefficient of expansion of this alloy, further, is well matched to the glass usually used for such a capsule.

DRAWINGS

DETAILED DESCRIPTION

Figure 1:
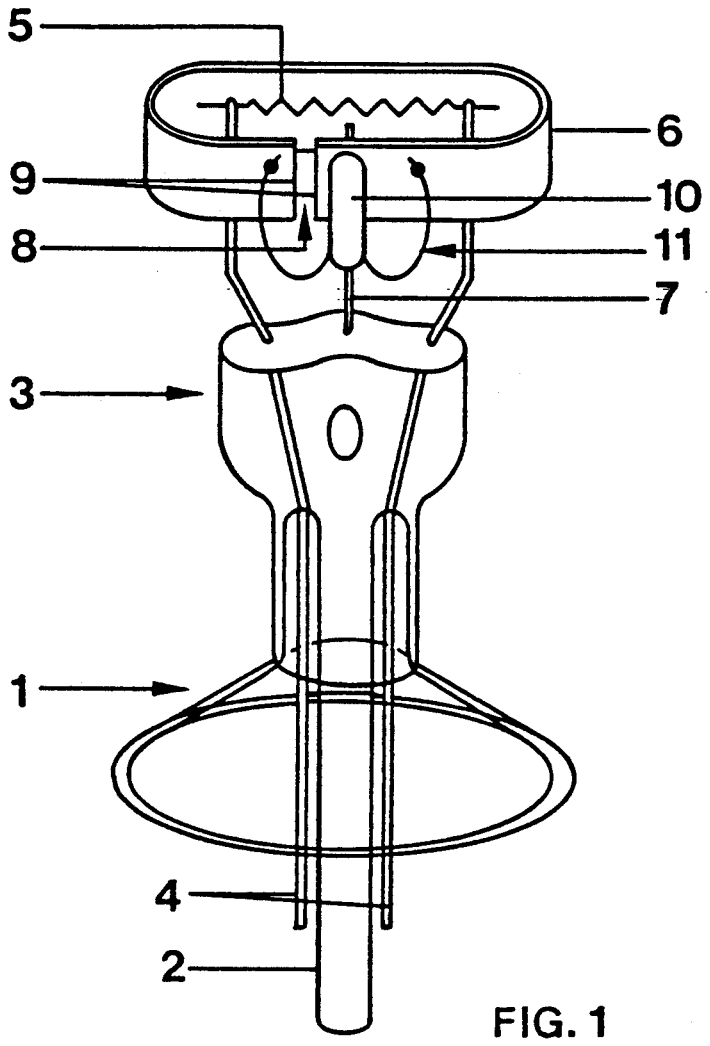
FIG. 1 is a pictorial view of an electrode mount in accordance with the invention, intended for a tubular fluorescent lamp, and illustrating a first embodiment.

The mount 1 (FIG. 1) is intended to be used with an elongated, straight, tubular fluorescent lamp; as well known, it includes a flare tube structure 1 which includes an exhaust tube 2, and terminates in a press seal 3. Two current supply leads 4 are melt-connected in the press seal 3 and retain a transversely positioned coiled electrode 5. A gapped band 6 forms a wrap-around shield, surrounding the electrode. This band is formed as a strip and, essentially, is bent into oval shape (see FIG. 2). The strip 2 prevents blackening of the lamp bulb in the vicinity of the electrode. It is secured in the press seal 3 by a wire 7, which is free from electrical potential. The ring of the strip 6 is not closed, but rather, is formed with a gap 8 to define a gapped spacing of from between about 0.5 to 1 mm width of the end portions 9 of the strip, see FIGS. 2 and 3.

Figure 3:
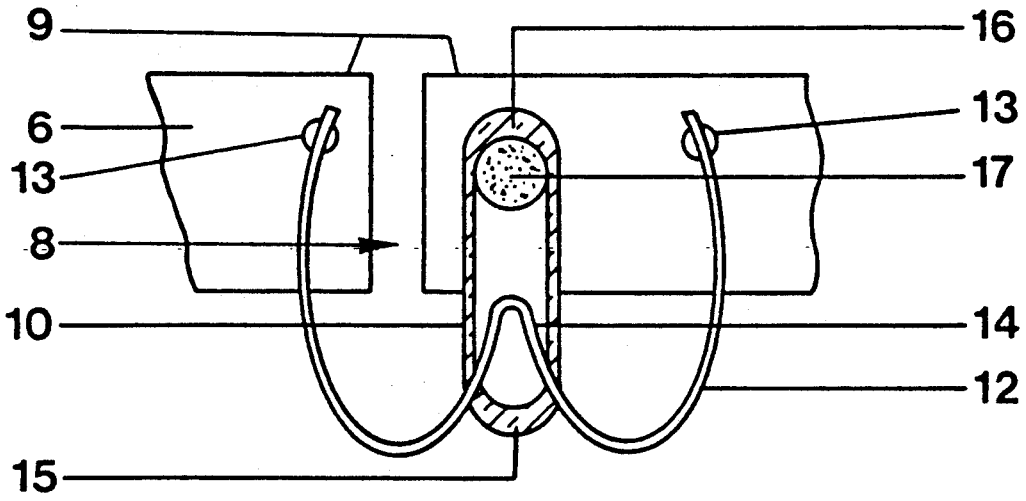
FIG. 3 is an enlarged part sectional front view showing the attachment of the mercury capsule to the gapped band.

In accordance with a feature of the invention, an elongated glass capsule 10, made of low melting point glass, for example lead glass known under the tradename Duran, or soda lime glass is located externally of the strip 6, positioned roughly in the level of the gap 8. It is offset from the gap 8, and positioned approximately transversely with respect to the filament 5. A heater wire 11 made, for example, of the material known under the tradename "Vacovit" is melted into the glass capsule 10. The wire bridges the gap 8 of the strip 6 and retains the glass capsule 10 in position. The heater wire 11 is formed somewhat or roughly in the shape of a W, with rounded corners. The wire diameter is about 0.3 mm. The two ends of the heater wire form outer long legs 12 of the W and are secured in the vicinity of the two ends 9 of the strip 6 by weld connections 13 (FIG. 3). The two, somewhat shorter inner legs 14 of the W form, with respect to each other, an acute angle and extend towards each other from spread-apart portions to an apex or tip. They are melted into a first end 15 of the elongated glass capsule 10. A portion of the glass capsule, including the first end 15 extends beyond the width of the strip 6 in the direction of the flare tube 1. The second end 16 of the glass capsule 10 is left free and terminates roughly at the level of the strip 6, or somewhat below. This end—and also the first end—is closed by heating, closing the opening of the capsule by surface tension.

The glass capsule has a length of about 9 mm, an outer diameter of 2.5 mm, and a wall thickness of the glass of about 0.2 mm.

The glass capsule is shown in section in FIG. 3. The quantity of mercury necessary for operation of the lamp is, in dependence on the type of the lamp, about 4–8 mg. It is retained within the glass capsule in one or more porous carrier bodies, in the form of tablets or pills 17, as described, for example, in detail in the referenced U.S. Pat. No. 4,808,136, assigned to the assignee of the present application. The tablet 17 is positioned at the second end 16 of the capsule 10. Other ways of introducing mercury into the capsule 10 are possible, for example to introduce a liquid drop, or an amalgam, within the capsule 10.

Preferably, the glass capsule 10 is offset laterally with respect to the gap 8 of the strip 6, in order to provide improved shielding around the coiled electrode 5.

Figure 2:
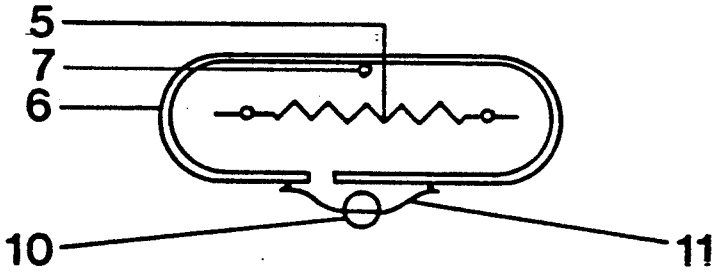
FIG. 2 is an end view of the gapped band and mercury capsule, and omitting any features not necessary for an understanding of the invention.
Figure 4:
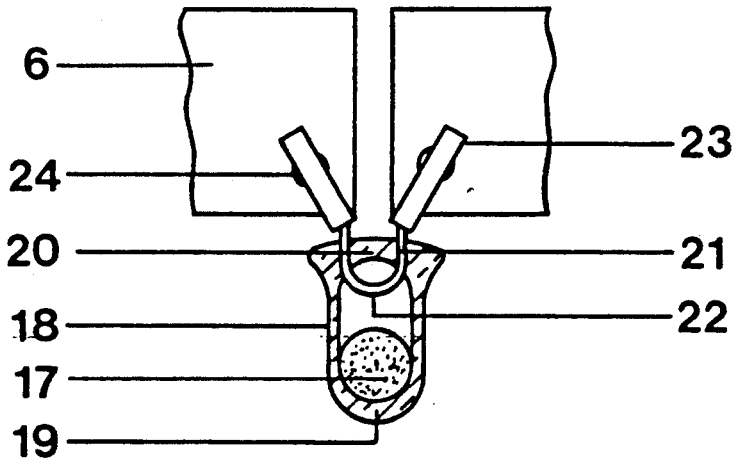
FIG. 4 is a view similar to FIG. 3, and illustrating another embodiment, in which the mercury capsule is shown in sectional representation.

FIG. 4 illustrates another embodiment of the basic structure, in which a glass capsule 18 is located 180° reversed with respect to the embodiment of FIGS. 1–3, and shortened. The second end 19 of the capsule 18 is directed towards the flare tube 1. The first end 20 of the glass capsule 18 forms a pinch seal which is advantageous in order to accommodate the shorter length of the capsule 18 that may cause a higher vapor pressure of mercury.

The two relatively thin legs 21 of the heater wire extend parallel to each other through the melt seal. The heater wires are relatively thin, having a diameter of only about 0.2 mm. They are joined interiorly of the capsule 18 by a U-shaped curved connecting portion 22. The two thicker ends 23 of the heater wire, for example having a diameter of about 1.5 mm, are angled off relative to the inner legs 21 by about 30° towards the outside and, similarly to the connection of the wire 12, are welded by spot welds 24 to the strip 6.

In both embodiments, the legs of the heater wire are placed under outwardly directed tension. In the embodiment of FIGS. 1–3, the heater wire is longer and the tension is somewhat less than that of the embodiment of FIG. 4.

In operation, a high frequency field is applied to the vicinity of the strip 6, resulting in heating of the heater wire. As the heater wire becomes hot, it will melt and tear the first end of the glass capsule, causing opening of the glass capsule, and thereby release of the mercury from the pellet or amalgam or liquid drop. A mercury pellet is preferred because it can be retained in the capsule after the opening thereof. The tear which forms in the melt connection of the first end of the capsule 10, FIGS. 1–3, is away from the major volume of the discharge space. The entire arrangement is somewhat less stiff than that of the embodiment of FIG. 4.

If desired, the glass capsule can be additionally attached to the strip 6 by a holding tab, for example punched out from the strip 6 and extending around the capsule 10, or in any other well known or suitable manner.

Figure 5:
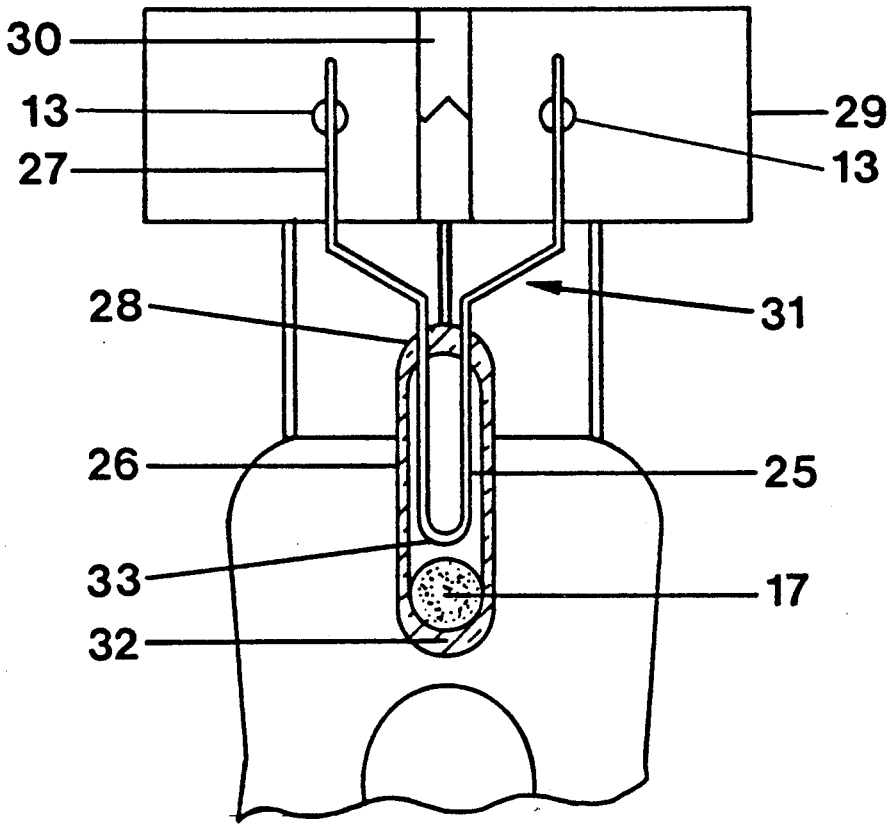
FIG. 5 is an enlarged fragmentary view of a further embodiment where the mercury capsule is shown in section.
Figure 6:
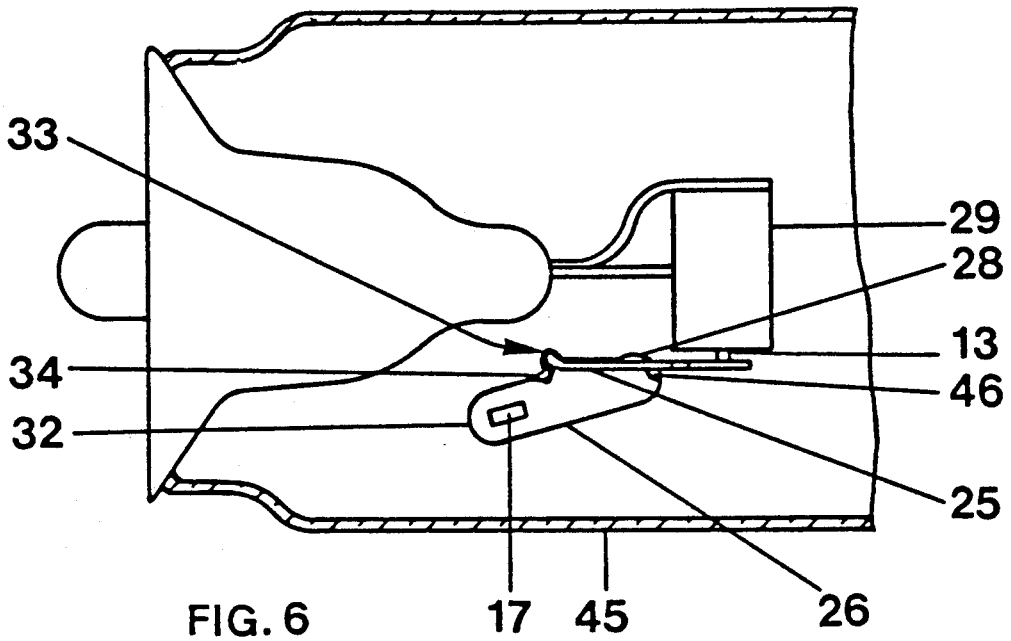
FIG. 6 is a pictorial representation of another mount, which is particularly suitable for a circular fluorescent lamp, where the capsule of the embodiment of FIG. 5 has been opened.

Referring now to FIGS. 5 and 6: the embodiment of FIG. 5 is particularly suitable for elongated tubular fluorescent lamps in which the fill is introduced when they are positioned horizontally, that is, when the glass capsule is in horizontal position when it is to be opened. The legs 25 of the heater wire extend therein through a substantial portion of the length thereof. The cylindrical capsule 26 is, for example, approximately 9 mm long, and the legs 25 extend therein for a distance of about 5 mm. The ends of the heater wire 27 are externally angled off just beyond the first end melt seal 28 of the glass capsule, and are then again angled to extend approximately parallel to each other. The ends of the heater wire, thus, are parallel to each other but spaced farther apart than within the glass capsule, which facilitates forming the connecting welds 13.

The strip or band 29, of essentially ring-shape, is somewhat pinched or compressed together before the heating wire 27 is welded thereto. The original width of the gap 30 of about 2 mm just prior to welding, is reduced to a gap of about 0.5 mm. After welding, the pinch is released, so that the heater wire 31 will have a resilient spreading force applied thereto which assists, upon application of high frequency induction to the strip 29, opening of the end 28 of the capsule 26.

As noted above, the structure is particularly suitable for opening when the lamp is in horizontal position. As best seen in FIG. 6, the horizontal position of the glass capsule 26 at the time that high frequency is induced, causes gravity, which has its center towards the second end 32 of the capsule to assist in opening thereof. The length of the glass capsule 26 functions similar to a lever arm. The end 32 tips, by gravity, downwardly. Since the legs 25 of the heater wire extend far into the interior of the capsule, a small tipping angle is all that is needed in order to permit a curved portion 33 of the heater wire to engage against the inner wall of the capsule. Due to the heat of the heater wire at this point and along the legs 25, a second opening 34 at the capsule will form and part of the wall adjacent the legs 25 will deform outwardly, keeping engaged the legs 25, when high frequency inductance is applied, so that the mercury can escape through two openings, namely the opening 46 adjacent to end 28 as well as the opening 34 where the heater wire engages the inner wall of the capsule 26. This is shown, somewhat exaggerated, in FIG. 6.

This arrangement, which provides for the formation of two openings in the capsule 26 ensures in a very reliable manner that the mercury can escape. Further, the danger that the glass capsule separates from the heater wire upon heating thereof is eliminated since the length of the inner legs and the additional holding element due to the tipped retention of the glass capsule, and the resulting melting-on of the curved portion 33 of the heater wire into the capsule minimizes separation of the capsule from the heater wire. The reliability of these functions can be still increased by slightly bending the curved portion 33 upwardly, as shown exaggerated and schematically in FIG. 6, so that the heater wire at the bend portion 33 will tough the inner wall of the capsule 26 rapidly, and result in effective holding of the capsule structure.

This solution is particularly suitable for lamps which receive the mercury portion of their fill while they are horizontal, and supplies an elegant way of providing a mercury container which is opened reliably while being, also, effectively retained. By suitably controlling the duration and intensity of the high frequency induction field, it is readily possible to control the formation of the second opening 34.

In some types of lamps, it is not necessary to provide the second opening 34, and, then, the induction field is so controlled that the curved portion 33 merely melts against the inner wall of the capsule 26 without melting through to form the hole 34, and then retain the remainder of the capsule in position.

Figure 7:
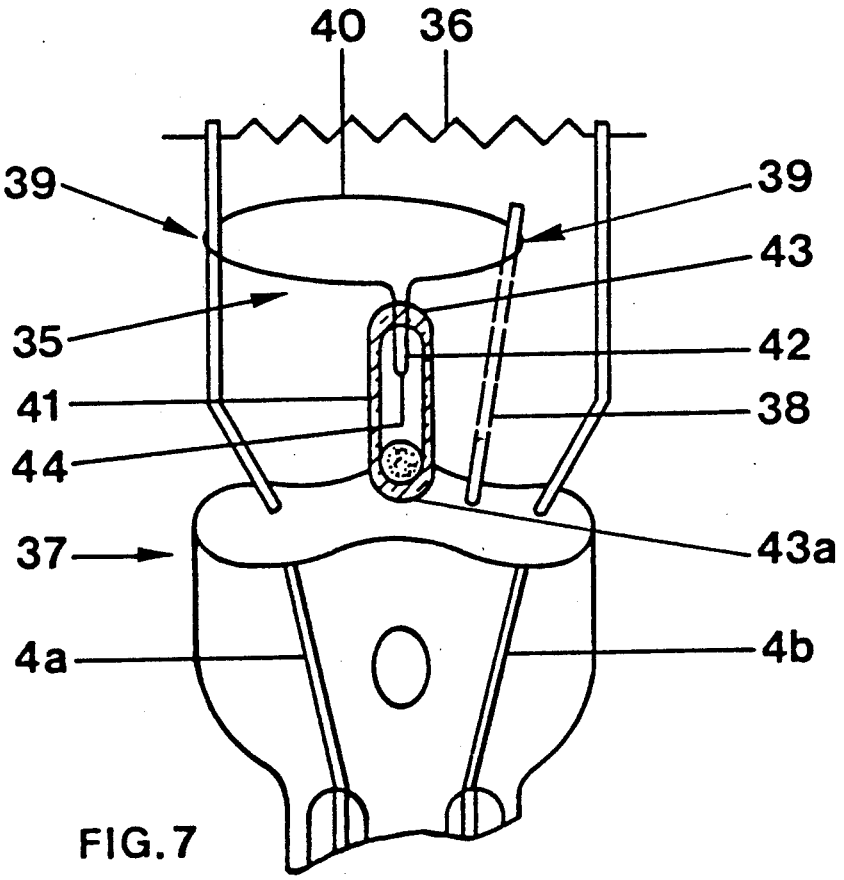
FIG. 7 is a pictorial representation of another embodiment which is particularly suitable for a circular fluorescent lamp.

FIG. 7 illustrates an embodiment which is particularly suitable for compact fluorescent lamps, circline fluorescent lamps, or other lamps which do not have a shield strip or band.

The heater wire 35 is secured to current leadins **4*a*, 4*b*, which extend through a pinch or press seal 37. Additionally, the heater wire 35 is secured beneath the filament 36 to one of the two current supply leads, as shown to the current supply lead 4*a* and—in a preferred embodiment—additionally to a separate support wire 38, melted into the pinch or press seal 37, and shown in broken lines in FIG. 7. It is, of course, equally possible to secure the heater wire 35 to two such support wires 38, separately melted into the pinch seal 37. The heater wire 35 is retained on the connecting lead 4*a*, as well as on the support wire 38 by spot welds 39. The two ends of the heater wire, which may be made of iron wire of 1.5 mm diameter are closed by a ring 40 which does not contact the second current supply lead 4*b***.

The mercury retaining glass capsule 41 is similar to that of the third embodiment (FIGS. 5, 6) and similarly positioned. The two legs 42 of the heater wire, extending into the capsule, and made of Vacovit, with a diameter of about 0.2 mm, extend parallel to each other and are melted into the melt at the first end 43 of the glass capsule 41. The ends of the heater wire are connected by a curved connecting portion 44. The axis of the capsule 41 and the legs 42 are perpendicular to the plane of the ring 40. It is, however, equally possible to place the plane of the ring 40 at an inclination, so that a portion of the ring is positioned in front of the electrode 36, or to locate the axis of the glass capsule in the plane of the ring 40. Such an arrangement is particularly suitable for lamps in which the current supply leads are secured by means of a glass bead, as well known in lamp manufacture.

The glass capsules, the heater wire connection therein, and connection to the seal or strip 6 can be made in various ways. For example, and with reference to the embodiment described in FIGS. 5 and 6, a glass tube is first provided and melted closed at the end 32 at a temperature of about 1,100° C. After being melt closed, it is slowly and gradually cooled. The still open tube is placed vertically, and a tablet, pill, or pellet 17 containing mercury is inserted into the tube while it is placed in an atmosphere of argon. The legs 25 of the heater wire are then introduced into the tube, still open at the upper end. The open upper end is then heated and melted shut. The now closed capsule 26 with the heater wire embedded therein is slowly cooled and the heater wire is then secured by spot welds 13 to the strip 29.

The heater assembly, or mount is introduced into the tubular fluorescent lamp, and the glass capsule is opened only later, when the lamp bulb 45 (FIG. 6) has been closed, with the mount inserted therein. The lamp bulb 45 is placed horizontally, with the capsule 26 in horizontal position, and an external high frequency field is applied from the outside of the now closed bulb 45, as is well known. Finally, the capsule is in the position shown in FIG. 6. The strip 29, including the heater wire form an electrically closed circuit. In the embodiment of FIG. 7, the wire 35 with the loop 40 and heater portions 42, 44 forms the closed circuit. By suitable selection of materials of the heater wire, or the portion thereof passing into the glass capsule, heating can be so controlled that only that portion of the heater wire which is in or against the glass capsule will heat substantially; the strip 29, respectively, the heater wire loop 40 will not heat substantially. Substantial heating of the portion of the heater wire external of the glass capsule should be avoided to prevent the emanation of contaminants therefrom.

The system of the present invention has a substantial advantage with respect to the environment, and particularly to prevent toxic contamination of the environment. If, due to some defect it is found that the finished lamp is not operative, or forms a "reject", it is not necessary to open the glass capsule, which might cause liberation of mercury. Rather, the glass capsule need not be opened so that it can be recovered as such and, further, the mercury pill or tablet 17 can be easily obtained therefrom. This effectively prevents contamination of the environment by mercury.

The present invention is not restricted to mercury low pressure lamps, such as fluorescent lamps, in elongated tubular, or ring-shape, or to compact fluorescent lamps. The present invention may be used with any lamp which is to contain mercury, such as high pressure lamps and the like.

Various changes and modifications may be made within the scope of the inventive concept.

We claim:

1. A discharge lamp having:

a vessel (45);

a fill which includes mercury within said vessel;

electrodes (5, 36) within the vessel;

a closed capsule (10, 18, 26, 41) within the vessel, the mercury being initially retained within said closed capsule;

a heater wire (11, 31, 35) thermally coupled to the capsule which, upon application of inductive heating thereof, opens the capsule; and electrically conductive means (6, 29, 40) secured within the vessel and electrically and mechanically coupled to the heater wire, wherein the capsule is a glass capsule and comprises an elongated tubular structure (10, 18, 26, 41) closed at both ends;

the heater wire is bent upon itself into essentially V or U-shape, defining two leg portions (14, 21, 25, 42) and said leg portions are melted into one end (15, 20, 28, 43) of the elongated glass capsule and are electrically connected (22, 23, 44) internally of the glass capsule.

2. The lamp of claim 1, wherein the leg portions (14, 21, 25, 42) of the heater wire are positioned essentially parallel to each other.

3. The lamp of claim 1, wherein the leg portions (14, 21, 25, 42) of the heater wire are coplanar and pass through the one end of the capsule, with respect to the elongated capsule, in essentially longitudinal alignment.

4. The lamp of claim 1, wherein said two leg portions (14, 21, 25, 42) are under tension stress.

5. The lamp of claim 4, wherein said heater wire (11, 31, 35) is springy, or resilient, and said tension stress within the heater wire is applied thereto during melt-in of the heater wire into said one end (15, 20, 28, 43) of the elongated capsule.

6. The lamp of claim 2, wherein said heater wire (11, 31, 35) comprises resilient springy material;

and wherein said leg portions are secured to said electrically conductive means under tension stress tending to spread apart the leg portions.

7. The lamp of claim 1, wherein both ends (**15, 16; 28, 32; 43, 43*a***) of the elongated glass capsule are closed by a melt seal.

8. The lamp of claim 1, wherein said one end (20) of the elongated capsule is closed by a press or pinch seal.

9. The lamp of claim 1, wherein the heater wire (11, 31, 35) has a higher electrical resistance than said electrically conductive means (6, 29, 40).

10. The lamp of claim 1, wherein (FIG. 4) said heater wire comprises a multi-element structure (21, 22, 23, 24) in which the respective elements have different electrical resistance;

and wherein the element with the highest electrical resistance is coupled to the elongated capsule.

11. The lamp of claim 10, wherein the heater wire comprises a iron-nickel-chromium alloy.

12. The lamp of claim 1, wherein at least the portion of the heater wire (11, 31, 35) which is coupled to the capsule (10, 18, 26, 41) has a diameter in the order of between about 0.2 to 0.4 mm.

13. The lamp of claim 1, wherein said elongated capsule (10, 18, 26, 41) comprises low melting point glass having a wall thickness of about 0.2 mm.

14. The lamp of claim1, wherein (FIGS. 5, 6, 7) said leg portions (25; 42) extend internally of the glass capsule through an essential longitudinal portion of the length of said capsule (26, 41).

15. The lamp of claim 1, further including an outwardly directed bent portion (12, 23, 27) formed on the heater wire and coupled to said leg portions (14, 21, 25), said outwardly directed portions being electrically and mechanically connected to said electrically conductive means (6, 29, 40).

16. The lamp of claim 1, wherein said electrically conductive means comprises a ring-shaped metallic band or shield or strip (6, 29) surrounding one of the electrodes (5, 36), said strip being circumferentially discontinuous and formed with a gap (8, 30), said heater wire being mechanically and electrically connected to said band or strip bridging said gap.

17. The lamp of claim 16, wherein the heater wire comprises flexible or resilient material;

said band or strip (6, 29) being resiliently deformable and applying resilient spreading tension on the heater wire mechanically connected across said gap.

18. The lamp of claim 1, wherein (FIG. 7) said electrically conductive means comprise a closed ring structure (40), secured to a current supply lead (**4*a*) supplying electrical energy to one of the electrodes (5, 36**).

19. The lamp of claim 1, further including an electrode mount (1) and current supply leads (**4, 4*a*, 4*b*) passing through said mount; and a potential-free support means (7; 38) melt-connected into said mount and forming a support element for said electrically conductive means (6, 29, 40**).

20. The lamp of claim 1, wherein said lamp comprises a low pressure mercury vapor discharge lamp.

* * * * *